US005519672A

United States Patent [19]

Zwolinski

[11] Patent Number: 5,519,672

[45] Date of Patent: May 21, 1996

[54] FISHMAN'S ALARM CLOCK

[76] Inventor: Aleksander S. Zwolinski, 10351 Fairway Rd., Pembroke Pines, Fla. 33026

[21] Appl. No.: 494,089

[22] Filed: Jun. 23, 1995

[51] Int. Cl.[6] ..... G04B 47/00

[52] U.S. Cl. ..... 368/10; 368/278; 368/223

[58] Field of Search ..... 368/10, 316, 276, 368/278

[56] References Cited

U.S. PATENT DOCUMENTS

| | | | |
|---|---|---|---|
| 1,420,549 | 6/1922 | Horn | 368/316 |
| 1,420,583 | 6/1922 | Simons | 368/316 |
| 3,875,738 | 4/1975 | Ichikawa | 58/57.5 |
| 4,097,905 | 6/1978 | Kramer | 360/12 |
| 4,405,241 | 9/1983 | Aihara | 368/63 |
| 4,445,786 | 5/1984 | Jackson | 368/10 |
| 5,226,021 | 7/1993 | Dell'olio | 368/12 |

FOREIGN PATENT DOCUMENTS 2124861 11/1972 Germany .

*Primary Examiner*—Bernard Roskoski
*Attorney, Agent, or Firm*—Alvin S. Blum

[57] ABSTRACT

An alarm clock simulates a fishing reel mounted on a fishing rod. The sound it makes simulates the reel clicker sound made by a fishing reel when a fish strikes and pulls line off the reel. This is a more pleasant and welcome sound to a fisherman. The clock is provided with an alarm on/off control that works in the same manner as the clicker on/off control on a reel. The sound volume control simulates the handle and star drag of a reel. The overall result is an alarm clock that looks, feels and sounds like a fishing reel.

4 Claims, 1 Drawing Sheet

FISHMAN' S ALARM CLOCK

BACKGROUND OF THE INVENTION

This invention relates to alarm clocks and more particularly to an alarm clock for a fisherman having the appearance, sound and feel of a sport fishing apparatus.

Fishermen often get up very early in the morning for best fishing results. They rely upon an ordinary alarm clock to wake them. The sound of the alarm is generally unpleasant and does not start the day on a pleasant note. A more cheerful sound would be desirable.

U.S. Pat. No. 5,226,021 issued Jul. 6, 1993 to Dell'Olio describes an alarm clock simulating a train visually and audibly.

Alarm clocks of various structures with various prerecorded alarm sounds are well known in the art. None of the prior art references teach or suggest unique visual, tactile and audible simulation of a fishing experience directed to a sleeping fisherman.

SUMMARY OF THE INVENTION

It is accordingly an object of the invention to provide an alarm clock that simulates a fishing apparatus visually, tactiley and audibly to provide a more pleasant waking experience and for a novel and attractive appearance.

DETAILED DESCRIPTION OF PREFERRED EMBODIMENT

Figure 3:
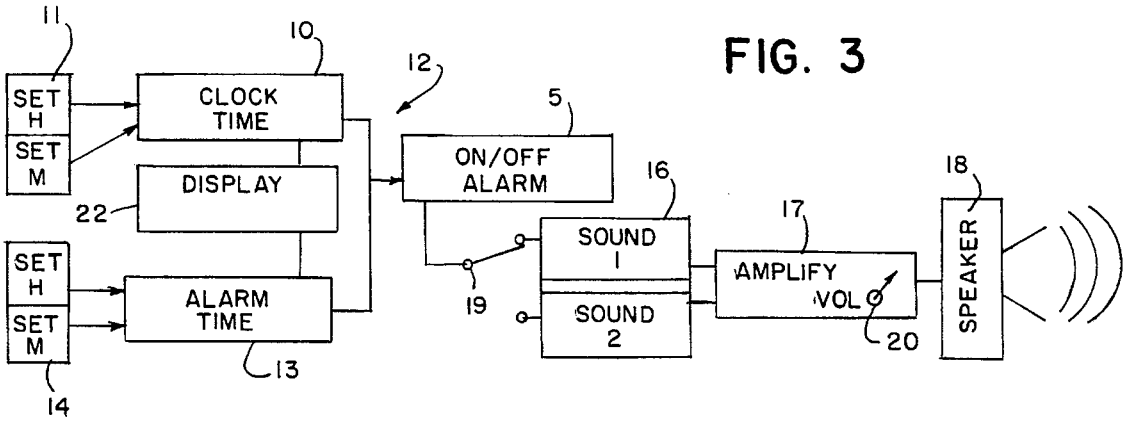
FIG. 3 is a block diagram of the clock operating mechanism.

Referring now first to FIG. 3, an electronic alarm clock mechanism 12 of the type well known in the art is shown in block diagram form. It includes a clock 10 with setting means 11, an alarm time register 13 with alarm setting means 14. When a time preset on register 13 is reached by clock 10 a signal is sent to the on/off switch 15, if the switch 15 is in the on mode, a prerecorded sound stored in sound generator 16 is sent to audio amplifier 17 which amplifies the sound and sends in to audio transducer 18. Several sounds may be stored, such as sound 1 and sound 2 may be stored by means well known in the art, such as read only memory (ROM) and either one may be selected by selector switch 19.

The volume control 20 may be provided to adjust sound intensity. The preferred two sounds are the continuous reel clicker sound and the intermittent reel clicker sound. Time is displayed by display 22 visible outside the housing.

Figure 1:
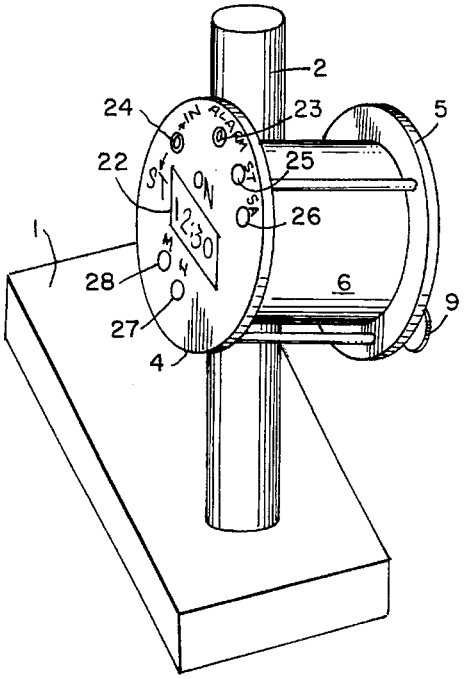
FIG. 1 is a perspective view of the clock of the invention viewed from a first side.
Figure 2:
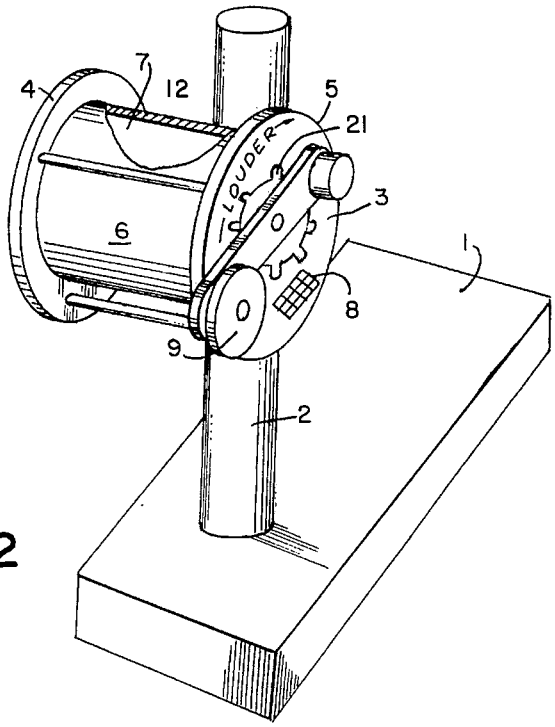
FIG. 2 is a perspective view of the clock of the invention viewed from a second side.

Referring now to FIGS. 1 and 2, the invention comprises a support base 1 on which is mounted a shaft 2 which simulates the lower portion of a fishing rod which normally supports the fishing reel. A housing 3 is attached to the shaft 2. The housing simulates a fishing reel such as a sport fishing reel used for deep sea fishing, for example. The housing comprises a discoidal left side plate 4 and a discoidal right side plate 5 joined together by a short hollow cylinder 6 defining a chamber 7 within which the alarm clock mechanism 12 is contained. The side plates simulate the side plates of a reel and the cylinder simulates the reel spool.

The side plates are provided with various elements necessary for the operation of the alarm clock with some of those elements simulating the elements of a reel. A grill or perforations 8 may overlie the audio transducer for enhanced sound transmission. A rotary handle 9 may be pivotally mounted on the plate to operate the volume control 20 seen in FIG. 3. This simulates the handle of a reel with star drag 21, the reel drag adjustment.

The time display 22 is presented at side plate 4. The control of the alarm on/off switch 15 is operated by the sliding control 23 which looks, feels, and operates the same as a reel clicker on/off control. Also shown is the external control 24 for selecting continuous or intermittent clicker sound.

Button 25 actuates resetting of the time and button 26 actuates resetting of the alarm time, both with hour reset button 27 and minute reset button 28 in a manner well known in the art.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An alarm clock comprising:

a base;

an elongate shaft simulating a portion of a fishing rod, said shaft affixed to said base and extending upward therefrom;

a housing attached to said shaft above said base, said housing simulating a fishing reel and including: a first discoidal side plate; a second discoidal side plate and a short hollow cylinder connecting the first and second side plates and defining a chamber therebetween, the cylinder simulating a reel spool and the side plates simulating the sides of a reel; an alarm clock mechanism enclosed within said chamber, said clock mechanism including a prerecorded alarm sound generating means for generating an alarm sound simulating the sound made by a reel clicker when line is pulled off a reel by a fish;

an alarm on/off switch mounted on one of the side plates and connected to said clock mechanism, the alarm on/off switch simulating the on/off clicker control on a fishing reel; and a rotary alarm sound volume control connected to said clock mechanism, said volume control mounted on one of the side plates and simulating the reel handle and star drag mechanism of a fishing reel.

2. The alarm clock according to claim 1, further comprising selector means connected to said clock mechanism for selecting between an alarm sound simulating a continuous clicker sound and an intermittent clicker sound simulating different varieties of fish pulling line off of a reel.

3. An alarm clock comprising:

a base;

an elongate shaft simulating a portion of a fishing rod, said shaft affixed to said base and extending upward therefrom;

a housing attached to said shaft above said base, said housing simulating a fishing reel and including: a first discoidal side plate; a second discoidal side plate and a short hollow cylinder connecting the first and second side plates and defining a chamber therebetween, the cylinder simulating a reel spool and the side plates simulating the sides of a reel; an alarm clock mechanism enclosed within said chamber, said clock mechanism including a prerecorded alarm sound generating means for generating an alarm sound simulating the sound made by a reel clicker when line is pulled off a reel by a fish;

an alarm on/off switch mounted on one of the side plates and connected to said block mechanism, the alarm on/off switch simulating the on/off clicker control on a fishing reel; and an elongate bar attached to one of the side plates, the bar having a center point and a knob at one end simulating a fishing reel handle.

4. The alarm clock according to claim 3, further comprising selector means connected to said clock mechanism for selecting between an alarm sound simulating a continuous clicker sound and an intermittent clicker sound simulating different varieties of fish pulling line off of a reel.

* * * * *